US005143220A

United States Patent [19]

Young et al.

[11] Patent Number: 5,143,220

[45] Date of Patent: Sep. 1, 1992

[54] APPARATUS FOR SCREENING TO REMOVE KNOTS FROM A FLUID BORNE SLURRY OF FIBERS AND KNOTS

[75] Inventors: Douglas L. G. Young, Nashua; Donald B. Johnson, Bedford, both of N.H.

[73] Assignee: Ingersoll-Rand Company, Woodcliff Lake, N.J.

[21] Appl. No.: 610,696

[22] Filed: Nov. 8, 1990

[51] Int. Cl.[5] ..... B07B 1/22

[52] U.S. Cl. ..... 209/17; 209/270

[58] Field of Search ..... 209/17, 270; 162/55

[56] References Cited

U.S. PATENT DOCUMENTS

| | | | |
|---|---|---|---|
| 2,047,808 | 7/1936 | Trimbey | 209/270 |
| 2,464,581 | 3/1949 | Jonsson | 209/270 |
| 2,483,200 | 9/1949 | Haug | 209/270 X |
| 3,311,235 | 3/1967 | Ahlfors et al. | 209/270 |
| 3,713,536 | 1/1973 | Hooper | 209/273 |
| 4,356,085 | 10/1982 | Schon et al. | 209/273 |
| 4,447,320 | 5/1984 | Lamort | 209/273 |
| 4,604,193 | 8/1986 | Lamort | 162/55 X |
| 4,842,722 | 6/1989 | Holz | 209/270 |
| 4,851,111 | 7/1989 | Martin et al. | 209/304 |
| 5,034,120 | 7/1991 | Niskanen et al. | 209/270 |

FOREIGN PATENT DOCUMENTS

| | | | |
|---|---|---|---|
| 0607866 | 5/1978 | U.S.S.R. | 209/273 |
| 0889767 | 12/1981 | U.S.S.R. | 162/55 |

*Primary Examiner*—D. Glenn Dayoan

*Attorney, Agent, or Firm*—Robert F. Palermo

[57] ABSTRACT

A screening apparatus removes a fluid borne pulp fiber slurry from knots which have been concentrated from a pulp processing stream. A rotating radially symmetrical screen provides centrifugal screening to accept a pulp fiber slurry while an integrally connected spiral flight conveyor transports knots from the inner surface of the screen to a knot discharge chamber located axially above the screening chamber. Above the screening chamber but below the liquid level in the housing, a fiber free wash liquor is provided through a tangentially oriented nozzle in the direction of rotation of the spiral flight conveyor to release fibers from the knot surfaces thereby enabling them to pass through the screen. The screening apparatus also provides for removal of heavy tramp materials, for maintaining liquid level control, for minimizing air entrainment and foam formation, and for preventing clogging of the screen apertures and knot discharge outlet.

22 Claims, 5 Drawing Sheets

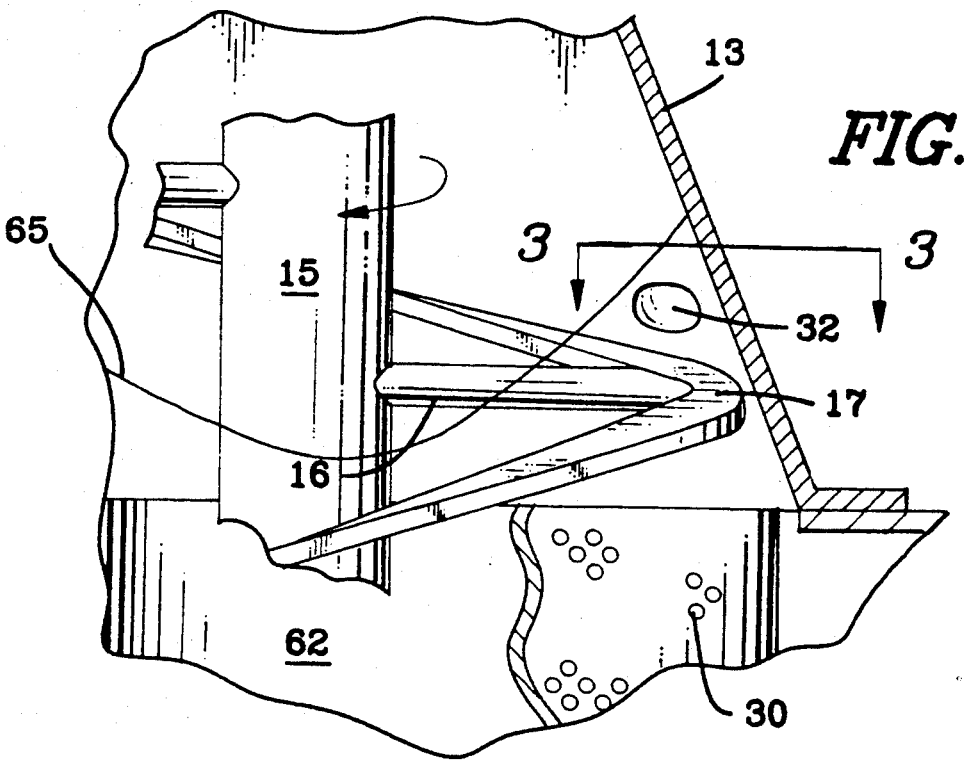
FIG. 2
FIG. 3
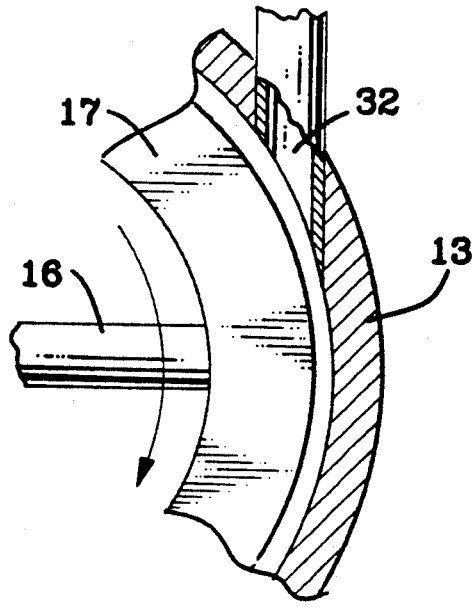

APPARATUS FOR SCREENING TO REMOVE KNOTS FROM A FLUID BORNE SLURRY OF FIBERS AND KNOTS

BACKGROUND OF THE INVENTION

This invention relates generally to separation of very large particles from a fluid borne stream of relatively fine particles by screening, and more particularly to coarse screening devices for washing and draining fine fiber/liquid suspension away from coarse nodules and/or other large particles.

For example in the digestion of wood for pulpmaking, a small fraction of chips become masked by other chips or are sufficiently digestion resistant to survive the digestion process and are commonly called knots. These and other undigested particles must be removed from the fluid borne pulp stream to prevent clogging of processing equipment and, ultimately, degradation of paper quality.

Removal of knots is normally accomplished in a knotter which screens the process slurry to remove them. A significant quantity of acceptable pulp is discharged along with the knots being rejected. This pulp must be separated from the knots before the knots are reprocessed or otherwise disposed of. In most cases, separation is accomplished in a knot drainer, which is a coarse screen which separates knots from pulp fibers and discharges the knots in a relatively dry and fiber free condition.

"Secondary" knot drainers, commonly consist of either high speed vibratory screens or generally vertical screw drainers. These may permit air entrainment with consequent foam generation which can adversely affect the process and require excessive defoamer consumption. In the screw type knot drainers, relative motion by the conveying screw and the screen plate can cause size reduction of the suspended particles. This "comminution" of knots can result in fibrous and resinous debris which is difficult to remove in downstream processing and which can degrade paper quality. Another consequence of using either type of secondary knot drainer may be discharge of an excessive amount of fiber with the knots. This fiber must either be recovered in further processing or be lost to production. Because of vibration and wear, maintenance costs for repair and replacement of screens and other components as well as lost production due to downtime for repairs can be unacceptably high. These and other disadvantages can reduce the efficiency of the knot removal and knot draining operation and hence increase the cost of producing clean pulp.

The foregoing illustrates limitations known to exist in present screening devices for removing coarse particles from a liquid borne fine particle slurry such as the various pulp types used in papermaking. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a screening apparatus for separating coarse solid particles from a fluid borne slurry, including a substantially vertical housing having a feed chamber located near the bottom of the housing for receiving a fluid borne suspension of very fine and very coarse solid particles. A screening chamber is provided within the housing above and communicating with the feed chamber and bounded by a rotatable cylindrical screen. A fine particle accepts chamber is located within the housing radially outboard of the screen and has a fine particle accepts outlet. A fluid free coarse particle discharge outlet is located at the top of the housing in communication with the screening chamber below A conveyor device is operatively associated with the screen for transporting the coarse particles upward through the screening chamber to the fluid free coarse particle chamber and outlet.

The foregoing and other aspects will become apparent from the following detailed description of the invention when considered in conjunction with the accompanying drawing figures.

BRIEF DESCRIPTION OF THE DRAWING FIGURES

FIG. 1 is a schematic partially sectional elevation view of the knot drainer of the present invention;

FIG. 1*a* shows the tramp particle accumulator and discharge arrangement;

FIG. 2 is a fragmentary elevation view taken in circled area 2 of FIG. 1 showing the knot/fiber wash nozzle;

FIG. 3 is a plan view from line 3—3 of FIG. 2 showing more detail of the wash nozzle;

DETAILED DESCRIPTION

Figure 1:
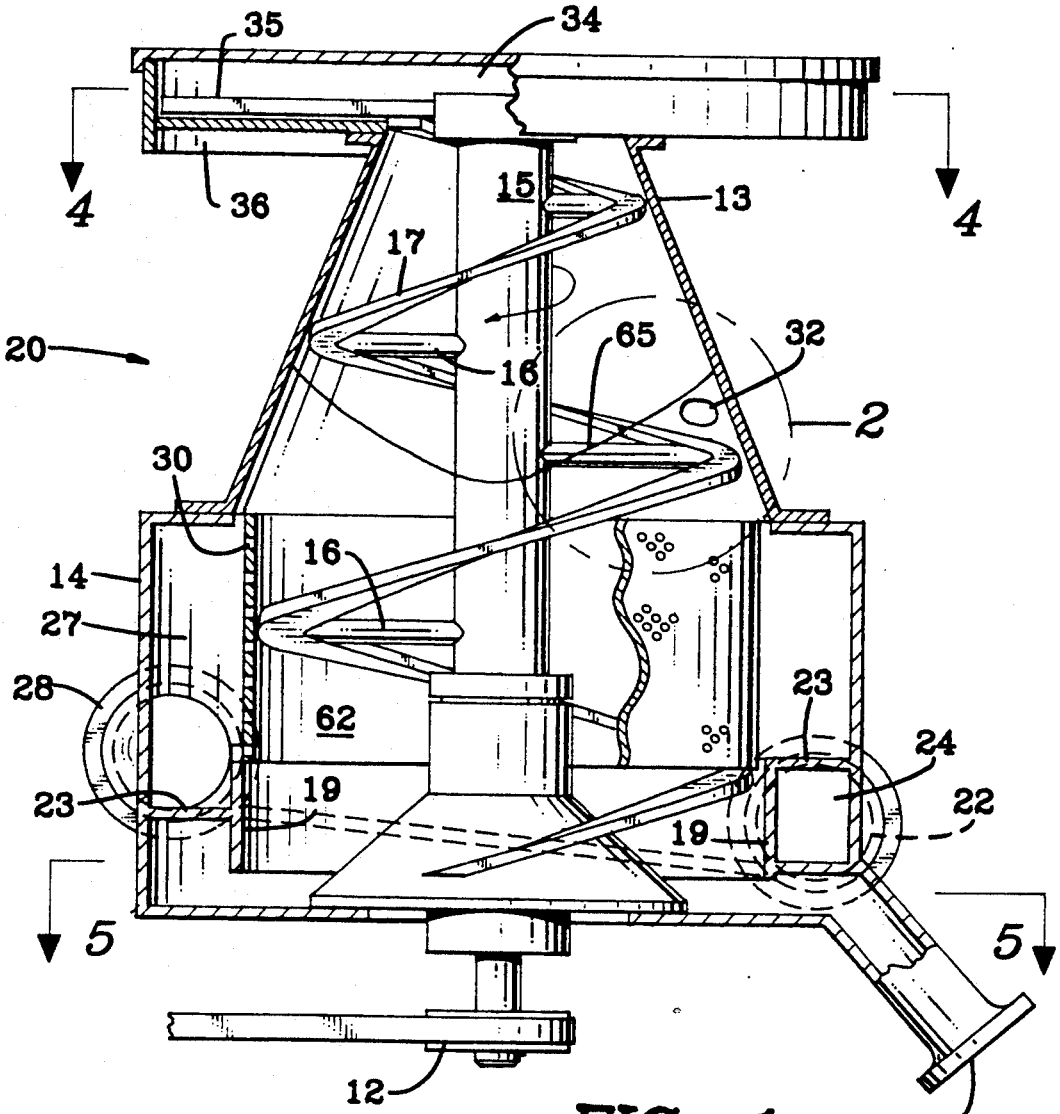

FIG. 1 shows several features of the knot drainer 20 of the present invention. Its housing is made up of a lower cylindrical section 14, an upper extension 13 formed in this instance as a truncated cone, and a fluid free coarse particle chamber 34 at the top.

A fluid borne slurry of fine particles together with very coarse particles is tangentially fed through inlet connection 22 and passes through feed chamber 24 in a circular path. Feed chamber 24 is bounded by inner wall 19, outer housing 14, and roof 23 which spirals downward from inlet 22 until it approaches the bottom of the inner wall 19 where it ends. The tangential feed path of the slurry imparts centrifugal force to the slurry and causes grit, stones, and other heavy tramp materials to be carried along at the housing wall 14 and finally to be deposited, for example, into a combined grit accumulator and discharge nozzle 26.

Since inner walls 19 end above the bottom of housing 14, the slurry enters the processing portion of the knot drainer by flowing under inner wall 19. Rotor shaft 15, which extends vertically at the center of the knot drainer, is supported on rotor base 11 which contains the standard bearings and seals required for pulp processing equipment. The rotor is driven through sheave wheels or other drive member 12 beneath the housing 14. A screw flight 17 begins near the bottom of inner wall 19 but more normally begins near the bottom of screen cylinder 30 and spirals to the top of housing extension 13. In the preferred embodiment, three flights 17 are provided, but for the sake of clarity, only one is illustrated here. Flights 17 are connected to rotor shaft 15 through brackets 16. A substantially cylindrical screen 30, which extends axially from about the top of inner wall 19 to slightly above the top of cylindrical housing 14, is firmly attached to the outer edge of the spiral flights 17. The upper portions of spiral flights 17 turn freely relative to the truncated conic section which forms the wall of housing extension 13. Screen 30 is sized to fit very closely to inner wall 19 and the upper flange of cylindrical housing 14 so that, although it is free to rotate relative to the walls, it is close enough to effectively prevent passage of undesirably large particles from screening chamber 62 into accepts chamber 27. Accepts chamber 27 is bounded on the outside by cylindrical housing 14, on top by the upper flange of cylindrical housing 14, on the bottom by roof 23 of inlet chamber 24, and on the inside partly by a portion of inner wall 19 and partly by cylindrical screen 30.

During operation, the vortex fluid surface 65 in the knot drainer is essentially concave as illustrated. Accept pressure of the slurry is adjusted to maintain the fluid level substantially as shown above screening chamber 62. This keeps the screen and the accepts chamber completely flooded so that foam formation will be minimized. The accepts slurry passes through screen 30 into accepts chamber 27 and is returned to the pulp processing stream through accepts outlet 28. Slightly above the top of screen 30 a nozzle 32 for introducing fiber free wash liquor is provided. A more detailed view of the area within circle 2 of FIG. 1 is shown in FIG. 2 while a plan view from line 3—3 of FIG. 2 is presented in FIG. 3. From these it can be seen that nozzle 32 introduces the fiber free wash liquor in the direction of travel of spiral flight 17, which is connected through bracket 16 with rotor shaft 15. Flights 17 describe helices of progressively decreasing diameters within housing extension 13. This allows them to rotate freely while maintaining a very close proximity to housing extension 13.

Housing extension 13 is preferably provided in the truncated cone shape illustrated although a straight cylindrical form is also possible. This provides the advantages of a steep contact angle between the fluid surface 65 and extension wall 13 which prevents liquid spillage into knot discharger 34, reduces turbulence and foam formation, and improves drainage of knots on the flights 17 above fluid surface 65. This improves elutriation performance of nozzle 32 and thus provides higher knot draining efficiency.

Figure 4:
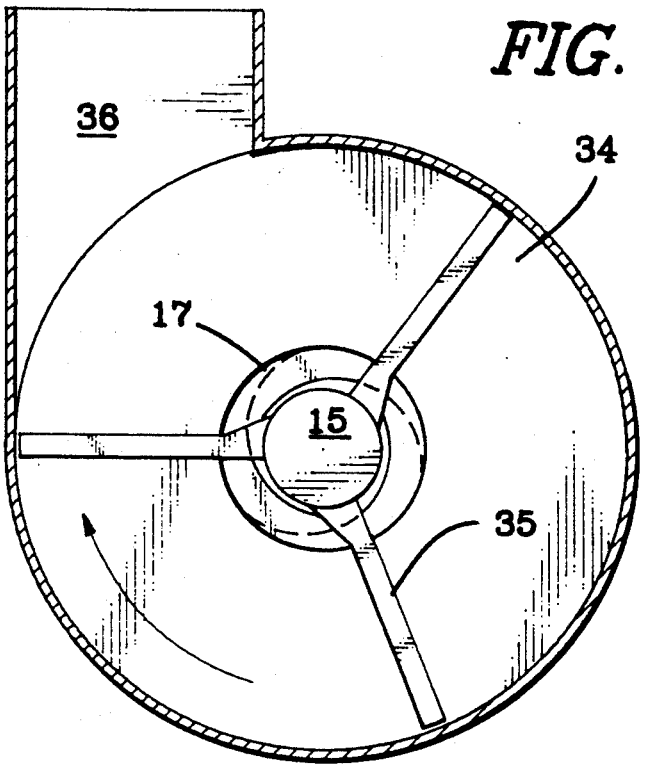
FIG. 4 is a plan view from line 4—4 of FIG. 1 showing the knot discharger.

Knot discharger 34 is shown at the top of knot drainer 20. It consists of a flat annular surface 38 attached at the top of housing extension 13. Rotor shaft 15 and flights 17 extend into the discharger where knots, as they arrive from the flights, are swept around surface 38 and outward to discharge outlet 36 by sweeper bars 35. This can be seen by observing FIG. 1 and FIG. 4 which is a plan view from line 4—4 of FIG. 1.

Figure 1A:
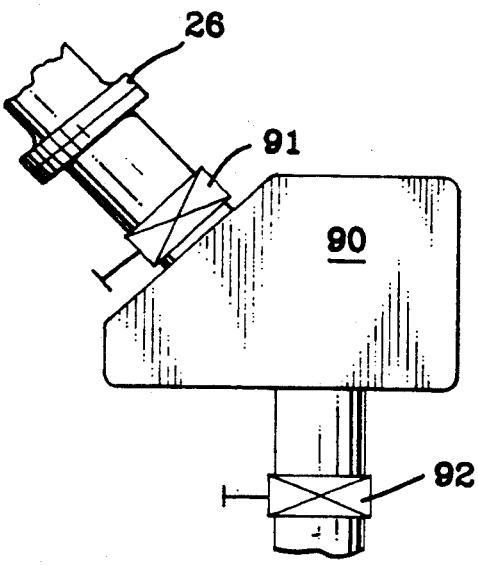
Figure 5:
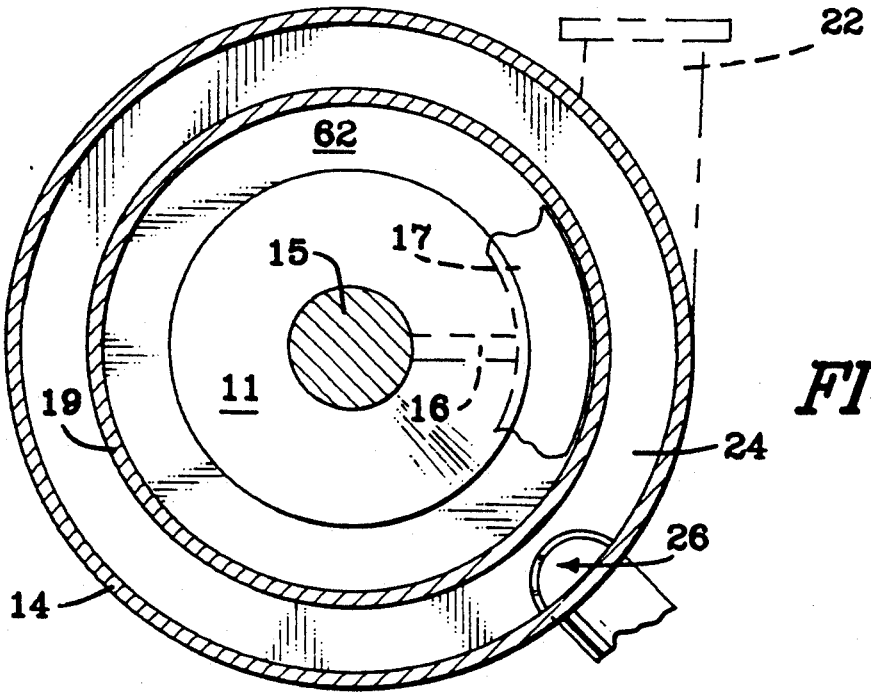
FIG. 5 is a plan view from line 5—5 of FIG. 1 showing the grit separator.

FIG. 5 is a plan view from line 5—5 of FIG. 1 to show the opening of the discharge nozzle 26 for grit, stones, metal and other heavy tramp material. The lower extremity of inner wall 19 is shown. As seen in FIG. 1, this member ends some distance above the bottom of housing 14 to permit entry of the feed slurry into screening chamber 62. The shadow of inlet 22 is shown to indicate the relative location of discharge nozzle 26 with respect thereto. The area outside inner wall 19 is the extension of feed chamber 24 which would be seen once the spiral roof of feed chamber 24 has reached the bottom of inner wall 19. Because of the higher density of the tramp metal, stones, and grit particles, they are vigorously thrust outward by the centrifugal force imparted by the downward spiralling inlet flow. This causes them to pass into and accumulate in discharge nozzle 26 above normally closed valve 91, as shown in FIG. 1*a*. Periodically, valve 92 is closed and valve 91 is opened to release the particles from nozzle 26 allowing accumulated tramp particles to fall into tramp particle accumulator 90. Then valve 91 is returned to closed position and the contents of accumulator 90 may be dumped by opening valve 92. Also shown in FIG. 5 is rotor base 11, rotor shaft 15, a support bracket 16, and the beginning of a spiral flight 17 which may be coextensive with the bottom extremity of inner wall 19. Employment of tramp particle accumulator 90 of FIG. 1*a* is an optional embodiment, as there may be preferable discharge means other than the two valve trap shown.

Figure 6:
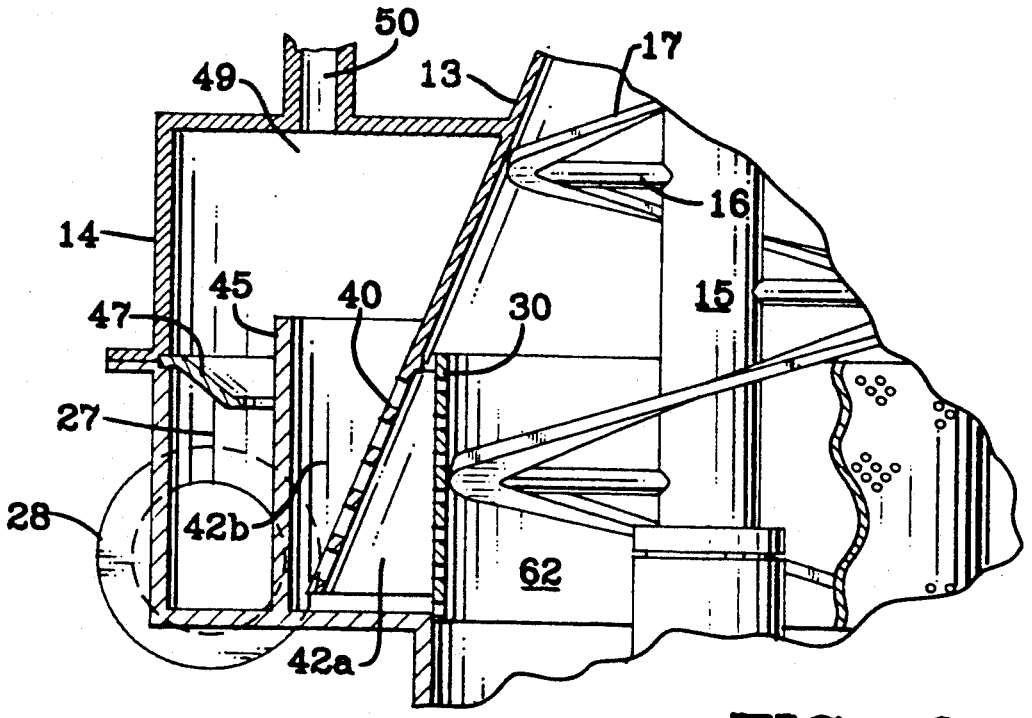
FIG. 6 is a fragmentary elevation view of a knot drainer showing the level control device of the present invention.

FIG. 6 shows an optional level control system for use with the present invention. It includes a downward extension of the stationary truncated conic housing extension 13. This downward extension is a vortex breaker 40 and is approximately axially coextensive with screen 30. It is shown in the figure as a perforated plate, but it may also be provided with vertical slots. With either holes or slots, vortex breaker 40 substantially eliminates the tangential flow of the accepts slurry and leaves only the radial component of flow. Level control weir 45 separates accepts chamber 27 from vortex chamber 42*a* and radial flow chamber 42*b*. As the slurry flows over weir 45 from radial flow chamber 42*b*, it pours over and through anti-splash baffle 47 into accepts chamber 27. Baffle 47 reduces air entrainment by further reducing the turbulence of the slurry flow. Vent 50 is provided at the top of level control chamber 49 to permit escape of any air released from the slurry.

FIGS. 7, 8, 9, and 10 illustrate two embodiments of a backwash device of the present invention which is provided to prevent occlusion of the apertures of screen 30 by knots and other coarse particles.

Figure 7:
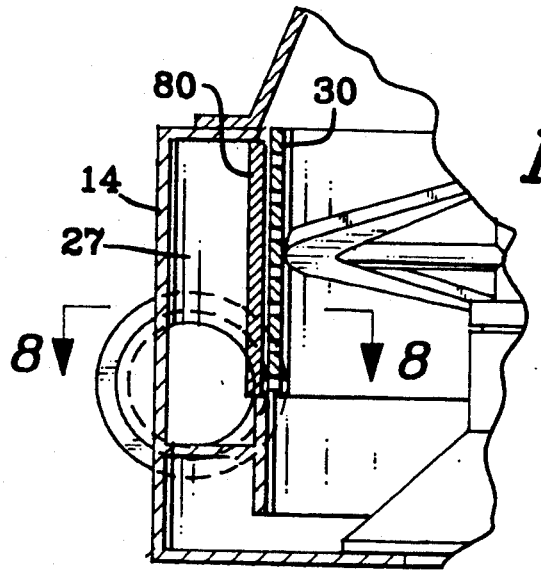
FIG. 7 is a fragmentary elevation view showing an optional hydrodynamic backwash pulse generator.
Figure 8:
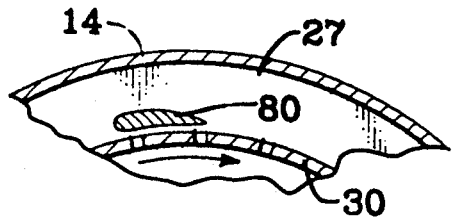
FIG. 8 is a plan view from line 8—8 of FIG. 7.

The embodiment shown in FIGS. 7 and 8 consists of a hydrodynamic foil 80 which is axially coextensive with and positioned outboard of screen 30 and in close radial proximity thereto. As the rotating screen 30 passes foil 80 the fluid borne slurry between them receives a pressure pulse which backwashes the screen apertures to expel knots which may otherwise plug the apertures.

Figure 9:
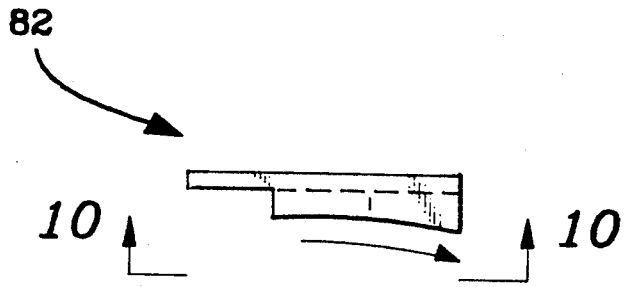
FIG. 9 is a plan view of an alternative form of the pulse generator of the present invention.
Figure 10:
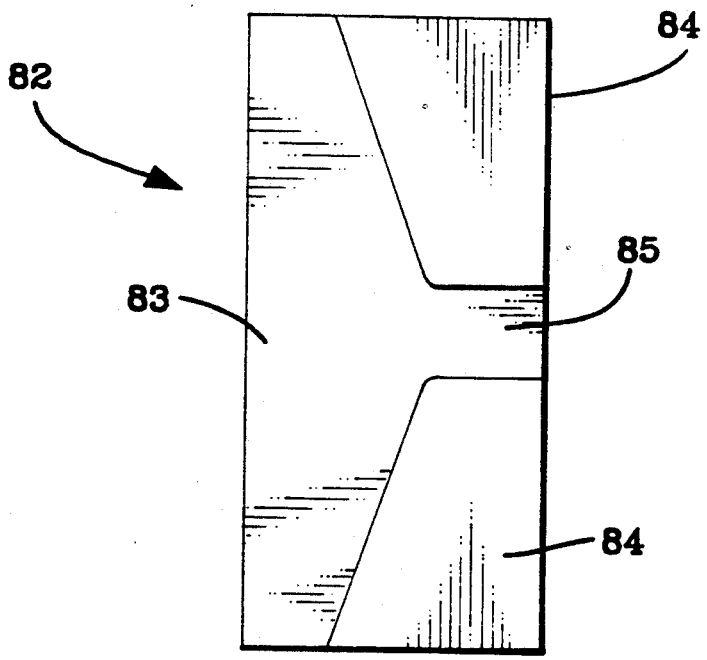
FIG. 10 is an elevation view from line 10—10 of FIG. 9.

An alternative embodiment of the hydrodynamic foil 82 is shown in FIGS. 9 and 10. In this case, foil 82 consists of an overhang 83 and two "heels" 84. Between heels 84 is a passage 85 through which the accepts slurry together with small coarse particles can escape. The geometry of foil 82 causes it to act like a flat fluid collection funnel with its inlet bounded by overhang 83 and screen 30 and its outlet 85 defined by heels 84 and screen 30. The standoff distance of overhang 83 from screen 30 is approximately the same dimension as the diameter or width of the screen apertures. This assures that small coarse particles which pass through the screen will not collect and jamb between foil 82 and screen 30.

Operation of a knot drainer, including all features described and illustrated in the figures, begins with introduction of the knot containing pulp slurry at inlet connection 22. From there it passes through inlet chamber 24 bounded by inner wall 19, cylindrical housing 14, and spiral roof 23. Centrifugal force generated by the tangential inlet and the confined circular flow path of the slurry causes heavy tramp particles to be segregated at the outer boundary of feed chamber 24 and to pass into nozzle 26 and thence through valve 91 when open into tramp particle accumulator 90 or other tramp particle accumulation system. The knot bearing pulp slurry, meanwhile, flows beneath inner wall 19 and upward into screening chamber 62. At the bottom of inner wall 19, the fluid borne slurry encounters spiral flights 17 which act as a screw conveyor to carry knots and pulp upward into screening chamber 62. Screening chamber 62 is that volume bounded by rotating cylindrical screen 30. Accepts chamber 27 is radially outboard of screen 30 and is drained through accepts discharge nozzle 28. Spiral flight 17 and rotating cylindrical screen 30 are firmly attached so that they rotate together. Rotary motion is transmitted from rotor shaft 15 to spiral flights 17 through support brackets 16. The knot bearing pulp slurry is screened by the apertures in screen 30 so that most of the accepts slurry is separated from the knots which are transported on rotating flights 17 through the screening chamber 62.

To prevent plugging of the apertures of screen 30, at least one backwash pulse inducer 80 or 82 is provided in accepts chamber 27. The pressure pulsations induced in the screen apertures as they pass the pulse inducer 80 or 82 expel fiber plugs to maintain flow through the apertures and also expel knots so that they continue their transport along rotating flights 17. The fluid surface 65 is concave due to the centrifugal forces imparted by the rotor. Slightly above screening chamber 62 but below liquid surface 65, a nozzle 32, tangentially fixed in stationary housing extension wall 13, introduces substantially fiber free liquor to release fibers from the reject knots. This liquor is introduced in the same direction as the rotation of spiral flights 17 in order to minimize turbulence and energy consumption and to prevent air entrainment. The fibers thus released are carried downward through the screening chamber 62 and pass into accepts chamber 27. The knots are transported upward on rotating flights 17 by the drag of the knots on the inclined stationary wall 13. Once above liquid surface 65, the knots quickly drain to a relatively dry condition as they are carried upward to discharge chamber 34. In one embodiment, knots are deposited on the flat annular surface 38 of the discharger and are impelled by discharger sweeper arms 35 and carried around and outward to knot discharger nozzle 36 where they are expelled in a substantially fiber free and relatively dry condition.

In cases where the level control feature is included, the fluid level in the knot drainer will be determined by the height of level control weir 45. Acceptable pulp slurry passes through rotating cylindrical screen 30, into vortex chamber **42*a*, through vortex breaker plate 40, which has a thickness greater than the width of its apertures such that substantially all of the tangential component of flow is suppressed and only the radial component remains, and into radial flow chamber 42*b*. The slurry thus flows smoothly over weir 45 and into accepts chamber 27 by passing over and through anti-splash baffle 47. The combination of the weir and the anti-splash baffle reduces air entrainment by limiting turbulence so that foaming is minimized and the pulp slurry discharge through accepts discharge nozzle 28 requires little if any defoamer. At the top of level control chamber 49 is vent 50** which is provided to permit the exit of any air released from the pulp slurry within the chamber.

The screen backwash function described herein could be performed by one or more slotted nozzle through which fiber free liquor is introduced, but that can cause unacceptable dilution. Hence, the hydrodynamic pulse inducers are preferable for that purpose.

Provision of a rotating radially symmetrical screen, whether conic or cylindrical, integrally connected to the spiral flight conveyor eliminates a source of often severe damage in knotters and knot drainers of standard configuration. Stones or other hard tramp particles which enter the screening chamber of a standard knotter or knot drainer are very likely to lodge between the stationary screen and the moving rotor or hydrofoil causing severe wear and damage to both members. In the present invention, stones or hard tramp particles that may escape the grit and tramp particle discharge provision will be carried upward on the spiral flight, but, since there is no relative motion between the spiral flights and the screen, the particles will merely roll or slide along the screen surface without any grinding or jamming behavior. Continuation of the spiral flight above the liquid level of the knot drainer permits discharge of substantially dry fibre free knots and a consequent reduction in the amount of reprocessing necessary.

Having described the invention, what is claimed is:

1. A screening apparatus for separating coarse solid particles from a fluid borne slurry, comprising:

a substantially vertical housing having a feed chamber means located near the bottom of said housing for receiving a fluid borne suspending of fine and coarse solid particles;

a screening chamber within said housing above and in communication with said feed chamber and bounded by a cylindrical rotatable screen having a vertical axis and fully immersed in said slurry;

a fine particle accepts chamber located within said housing radially outboard of said screen and having a fine particle accepts outlet;

a fluid free coarse particle discharge outlet located at the top of said housing in communication with said screening chamber below; and means operatively associated with said screen for transporting said coarse particles upward through said screening chamber to said fluid free coarse particle discharge outlet.

2. The screening apparatus of claim 1, wherein said transporting means comprises at least one rotatably supported spiral flight connected to said screen.

3. The screening apparatus of claim 2, wherein said spiral flight extends above the cylindrical rotatable screen and is closely bounded by a stationary housing extension above said screening chamber which provides communication between the screening chamber and the coarse particle discharge outlet which is located within a fluid free coarse particle discharge chamber portion of the housing.

4. The screening apparatus of claim 3, wherein said spiral flight and said stationary housing extension have truncated conical forms which taper inwardly toward an opening through which coarse particles are fed into the coarse particle discharge chamber portion of said housing.

5. The screening apparatus of claim 1, wherein a fluid free coarse particle discharge chamber communicates with the screening chamber through a stationary housing extension located above said screening chamber and below said discharge chamber.

6. The screening apparatus of claim 5, wherein said housing extension is a truncated cone which tapers inwardly toward an opening through which coarse particles are fed into the coarse particle discharge chamber.

7. The screening apparatus of claim 5, wherein the means for transporting the coarse particles from the screening chamber comprises at least one rotatably supported spiral flight connected to said screen and extending above said screen through said stationary housing extension into said fluid free coarse particle discharge chamber.

8. The screening apparatus of claim 1, further comprising:

a tangentially oriented fluid inlet nozzle near an outlet portion of said screening chamber for introducing substantially fiber free liquor near a liquid/air interface above said screening chamber for releasing said fine particles from said coarse particles.

9. The screening apparatus of claim 8, wherein the substantially fiber free liquor is introduced in the direction of rotation of said transporting means.

10. The screening apparatus of claim 3, wherein the fluid free coarse particle discharge chamber further comprises:

a radially extending annular surface providing communication from said transporting means to said coarse particle discharge outlet; and means for sweeping said radially extending annular surface for urging of said coarse particles into the coarse particle discharge outlet.

11. The screening apparatus of claim 10, wherein the means for sweeping the radially extending annular surface comprises a portion of a rotatably supported shaft extending into said fluid free coarse particle chamber, and at least one radially projecting rotatable bar connected to said shaft so as to sweep over and in close axial proximity to said radially extending annular area.

12. The screening apparatus of claim 1, further comprising:

means for removing grit, stones, metal, and other tramp material from the slurry prior to screening.

13. The screening apparatus of claim 12, wherein the means for removing grit, stones, metal, and other tramp material from the slurry prior to screening comprises a tangential slurry inlet nozzle, a feed chamber having an approximately 360 degree circumferential extent and in fluid communication with said slurry inlet nozzle, means for at least maintaining the tangential velocity of the feed slurry, a grit discharge nozzle projecting through the housing downwardly and outwardly from the lower outer edge of the feed chamber, and a tramp particle accumulator.

14. The screening apparatus of claim 13, further comprising:

means for removing accumulated grit, stones, metal, and other tramp material from said tramp particle accumulator.

15. The screening apparatus of claim 1, further comprising:

means for controlling the liquid level in said screening apparatus.

16. The screening apparatus of claim 15, wherein the means for controlling the liquid level comprises a top vented liquid level control chamber radially outboard of the rotating screen, means for substantially eliminating the tangential component of fluid flow in a vortex reduction section of the liquid level control chamber, a weir radially outboard of the vortex reduction section for establishing a liquid level limit, and means for reducing fluid turbulence and air entrainment.

17. The screening apparatus of claim 1, further comprising:

means for creating a backwash fluid flow sequentially through successive vertical rows of apertures in the rotatable screen.

18. The screening apparatus of claim 17, wherein the means for creating the backwash fluid flow comprises at least one stationary hydrodynamic pulse generating device placed in close proximity to a circumferential surface of the rotatable radially symmetrical screen.

19. A knot drainer for separating acceptable pulp fibers from knots in a fluid borne slurry, comprising:

a substantially vertical housing having a feed chamber means, located near the bottom of said housing for receiving a fluid borne suspension of knots containing acceptable pulp fiber;

a screening chamber within said housing above and communicating with said feed chamber and bounded by a cylindrical rotatable screen;

an accepts chamber located within said housing radially outboard of said screen and having an accepts outlet;

a knot discharge chamber located at the top of said housing in communication with said screening chamber below and having a knot discharge outlet; and means connected to said screen for transporting said knots upward from said screening chamber to said knot discharge chamber.

20. The knot drainer of claim 19, further comprising:

washing means above said screening chamber for releasing said acceptable pulp fibers from knots.

21. An apparatus for generating hydrodynamic pulses, in a substantially cylindrical vertically oriented screening device for wood pulp processing, comprising:

a rotating open bottom screen fully immersed in a fluid; and a rigid stationary substantially rectangular plate having its length dimension transverse to a direction of relative motion between said screen and said plate and axially coextensive with said screen; said plate further comprising:

a leading overhang portion having a reduced thickness which, together with said screen surface, defines a fluid collection gap of a thickness which is proportional to the apertures of said screen; and a trailing portion having two heel regions of a thickness also proportional to the apertures of said screen, said regions being separated by a passage which is an extension of said fluid collection gap so that said overhang, heels, and passage define a flat funnel in conjunction with said screen surface.

22. The hydrodynamic pulse generating apparatus of claim 21, wherein said trailing portion of said rigid member has two heel regions which are so contoured as to define a constant narrow gap in conjunction with said screen.

* * * * *